US005792323A

United States Patent [19]

Grondahl

[11] Patent Number: 5,792,323

[45] Date of Patent: Aug. 11, 1998

[54] SPIRAL BASE STRUCTRES FOR LONG NIP PAPER MACHINE PRESS BELTS

[75] Inventor: Erik Wilhelm Grondahl, Velp, Netherlands

[73] Assignee: Albany International Corp., Albany, N.Y.

[21] Appl. No.: 524,470

[22] Filed: Sep. 7, 1995

[51] Int. Cl.[6] ..... D21F 1/10; D21F 3/02

[52] U.S. Cl. ..... 162/358.4; 162/901; 156/184; 156/193; 156/195; 156/304.1; 442/167; 442/60; 198/846

[58] Field of Search ..... 162/358.4, 901, 162/902, 358.3; 428/60, 167, 172, 217, 295, 57; 156/154, 171, 176, 190, 193, 195, 268, 73.4, 93, 184, 189, 191, 134, 304.1; 198/846, 847

[56] References Cited

U.S. PATENT DOCUMENTS

| | | | |
|---|---|---|---|
| 5,196,092 | 3/1993 | Stigberg | 162/358.4 |
| 5,208,087 | 5/1993 | Stigberg | 428/60 |
| 5,238,537 | 8/1993 | Dutt | 162/358.4 |
| 5,507,889 | 4/1996 | Watanabe et al. | 156/154 |

FOREIGN PATENT DOCUMENTS

| | | | |
|---|---|---|---|
| 2958800 | 11/1992 | Canada | D21F 1/10 |
| 0 194 602 | 9/1986 | European Pat. Off. | S21F 3/02 |

*Primary Examiner*—Donald E. Czaja
*Assistant Examiner*—Jose A. Fortuna
*Attorney, Agent, or Firm*—Kane, Dalsimer, Sullivan, Kurucz, Levy, Eisele and Richard, LLP

[57] ABSTRACT

A belt for use on a long nip press for dewatering a fibrous web includes a base assembled by spirally winding a prepared structure strip in a plurality of non-overlapping turns. Successive turns are abutted against and joined to those previously wound by sewing or otherwise bonding along the continuous spiral seam thus formed. The prepared structure strip may be a fabric strip woven from lengthwise and crosswise yarns, which may be monofilament yarns of a synthetic polymeric resin. The fabric strip may be of either a single- or multi-layer weave. At least one side of the base, namely, that side which will be on the inside of the belt in its endless loop form, and which slides over the arcuate pressure shoe component of the long nip press during its operation, is coated with a polymeric resin, such as polyurethane, to render it impervious to liquids, and especially to the oil used to lubricate the surface of the arcuate pressure shoe. The coating is ground and buffed to provide the belt with a smooth surface and a uniform thickness.

23 Claims, 6 Drawing Sheets

SPIRAL BASE STRUCTRES FOR LONG NIP PAPER MACHINE PRESS BELTS

BACKGROUND OF THE INVENTION

1. Field of the Invention

The present invention relates to mechanisms for extracting water from a web of material, and more particularly from a fibrous web being processed into a paper product on a papermaking machine. Specifically, the present invention is an impermeable belt designed for use in conjunction with a long nip press on a papermaking machine, and a method for making the impermeable belt.

2. Description of the Prior Art

During the papermaking process, a fibrous web is formed on a forming wire by depositing a fibrous slurry thereon. A large amount of water is drained from the slurry during this process, after which the newly formed web proceeds to a press section. The press section includes a series of press nips, in which the fibrous web is subjected to compressive forces designed to remove water therefrom. The web finally proceeds to a drying section which includes heated dryer drums around which the web is directed. The heated dryer drums reduce the water content of the web to a desirable level through evaporation.

Rising energy costs have made it increasingly desirable to remove as much water as possible from the web prior to its entering the dryer section. The dryer drums are often heated from within by steam and related costs can be substantial especially when a large amount of water needs to be removed from the web.

Traditionally, press sections have included a series of nips formed by pairs of adjacent cylindrical press rolls. In recent years, the use of long press nips has been found to be advantageous over the use of nips formed by pairs of adjacent press rolls. The longer the time a web can be subjected to pressure in the nip, the more water can be removed there, and, consequently, the less water will remain behind in the web for removal through evaporation in the dryer section.

The present invention relates to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip is formed which can be five to ten times longer in the machine direction than one formed between two press rolls. This increases the so-called dwell time of the fibrous web in the long nip while maintaining the same level of pressure per square inch in pressing force used in a two-roll press. The result of this new long nip technology has been a dramatic increase in dewatering of the fibrous web in the long nip when compared to conventional nips on paper machines.

A long nip press of the shoe type requires a special belt, such as that shown in U.S. Pat. No. 5,238,537. This belt is designed to protect the press fabric supporting, carrying and dewatering the fibrous web from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness at least on the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web.

Long nip press belts, such as that shown in U.S. Pat. No. 5,238,537, depending on the size requirements of the long nip presses on which they are installed, have dimensions of length from 10 to 40 feet, measured longitudinally around its endless-loop form, and of width from 100 to 450 inches, measured transversely across. Whether its woven base fabric is flat-woven, and subsequently seamed into endless form, or is woven endless in tubular form, large weaving looms are required for their production. In either case, the weaving process is a time-consuming and cumbersome operation, as the woven base fabric must have the same dimensions as the finished long nip press belt.

The present invention provides a solution to this problem in the form of a spiral base fabric wherein a plurality of spirally wound and joined turns of a relatively narrow woven fabric may be used as an endless base fabric for a long nip press belt.

SUMMARY OF THE INVENTION

Accordingly, the present invention is a belt on a long nip press for dewatering a fibrous web, and a method for manufacturing the belt. The belt comprises a base assembled by spirally winding a prepared structure strip, for example, around two parallel rolls. The prepared structure strip may be a fabric strip woven from lengthwise and crosswise yarns and has a smaller width than the width of the base as a whole.

The base is a plurality of non-overlapping turns of the spirally wound prepared structure strip. Preferably, adjacent turns are abutted against one another and joined together by stitching or bonding. The base so produced has the form of an endless loop with an inner surface, an outer surface, a longitudinal direction, and a transverse direction.

Where the prepared structure strip is a fabric strip spirally wound to produce a woven base fabric, the lengthwise and crosswise yarns of the fabric strip do not align with the longitudinal and transverse directions of the woven base fabric, respectively, the latter being taken with reference to the endless loop form of the woven base fabric. Indeed, the lengthwise yarns of the spirally wound fabric strip are inclined at an angle with respect to the longitudinal direction of the woven base fabric. The angle, typically small, is a measure of the pitch of the spiral winding.

In general, the lateral edges of the base, following assembly from the spirally wound prepared structure strip, require trimming to be made parallel to the longitudinal direction thereof.

A coating of a polymeric resin is provided at least on the inner surface of the base. The coating renders the base impervious to liquids, and is smooth and provides the belt with a uniform thickness. The coating impregnates the base, where the base is a fabric, and, in general, is preferably ground and buffed to provide the belt with a smooth surface and a uniform thickness.

The method for manufacturing the belt comprises the step of manufacturing a suitable prepared structure strip. Where the prepared structure strip is a woven fabric strip, it is woven from lengthwise and crosswise yarns in a preselected width. Preferably, the woven fabric strip is heat-set following its manufacture by weaving, and accumulated on a stock roll for later use.

The fabric strip is then wound, for example, around two parallel rolls, in a plurality of non-overlapping turns to assemble a woven base fabric. Each turn is preferably abutted against those adjacent thereto, and joined therewith by stitching or bonding. A woven base fabric, having an inner surface, an outer surface, a longitudinal direction and a transverse direction is the result. The lateral edges of the woven base fabric are then preferably trimmed, as discussed above, to render them parallel to the longitudinal direction of the woven base fabric.

Alternatively, the prepared structure strip may be a non-woven fabric strip, a perforated synthetic strip, or a polymeric film strip. By a non-woven fabric is meant a fiber structure produced by means other than weaving. Examples are spun-bonded fiber structures and fiber structures whose component fibers are bonded together at their crossover points by heat. Generally, these fiber structures are made from thermoplastic materials. The non-woven fabric may also be a needle-punched fiber structure.

The perforated synthetic strip may be a sheet of nylon extruded film or polyester film, either of which could be spirally wound and bonded. The strip can be perforated after extrusion in any of a number of patterns. Examples are round holes, square holes, chevron-shaped holes and diamond-shaped holes.

The polymeric film strip is identical to the perforated synthetic strip except that it lacks perforations.

In each case, the prepared structure strip is spirally wound, and each turn of the spiral winding thereof joined to those adjacent thereto by stitching or bonding in the manner described above to produce the base. The bonding methods may be mechanical in nature, for example, butt sewing or fiber entanglement. Such methods could be used where the prepared structure strip is either a woven or a non-woven fabric strip. Ultrasonic welding and heat fusion could be used with any of the varieties of prepared structure strip. Chemical bonding could also be used with any of the prepared structure strips.

At least one of the inner and outer surfaces of the base is then coated with a polymeric resin to cover the base and to form a layer of the polymeric resin on the chosen surface, providing the belt with a desired thickness.

The polymeric resin is then cured, and, preferably, ground and buffed to provide the belt with a smooth surface and a uniform thickness.

The present invention permits the use of a relatively narrow piece of prepared structure strip to create a large endless base by spiralling the narrow piece and by stitching or bonding the lateral edges of adjacent turns of the spiral together. A loom as narrow as 2 inches could be used to produce a prepared structure strip in the form of a woven fabric strip, but, for reasons of practicality, a conventional textile loom having a width from 60 to 120 inches may be preferred.

In any event, it will be recognized that endless bases of a variety of widths and lengths may be provided by spirally winding a relatively narrow piece of prepared structure strip around two parallel rolls, the length of a particular endless base being determined by the separation between the two parallel rolls, and the width being determined by the number of spiral turns of the prepared structure strip. The current necessity of manufacturing complete bases of specified lengths and widths to order may thereby be avoided.

The present invention will now be described in more complete detail with frequent reference being made to the figures, which are listed and identified as follows.

DETAILED DESCRIPTION OF THE PREFERRED EMBODIMENT

Figure 1:
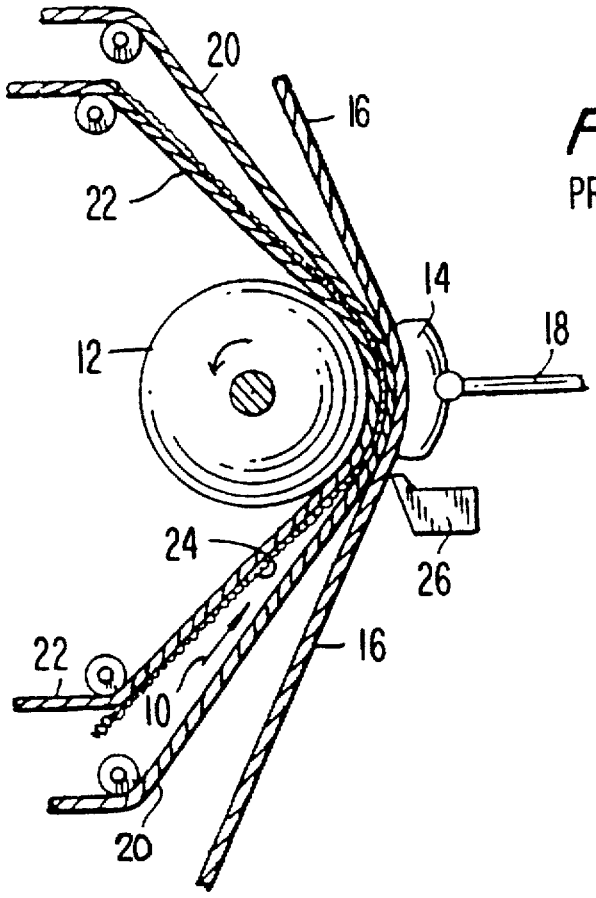
FIG. 1 PRIOR ART
FIG. 1 is a side elevational view of a long press nip for which the belt of the present invention is intended.
Figure 2:
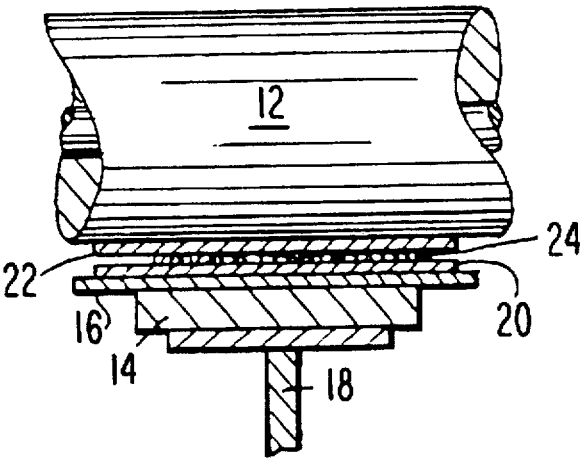
FIG. 2 PRIOR ART
FIG. 2 is a partially sectioned front view of the press nip shown in FIG. 1.

A long nip press for dewatering a fibrous web being processed into a paper product on a paper machine is shown in FIGS. 1 and 2. The press nip 10 is defined by a smooth cylindrical press roll 12, an arcuate pressure shoe 14, and a belt 16 of the present invention arranged such that it bears against the surface of the cylindrical press roll 12. The arcuate pressure shoe 14 has about the same radius of curvature as the cylindrical press roll 12. The distance between the cylindrical press roll 12 and the arcuate pressure shoe 14 may be adjusted by means of conventional hydraulic or mechanical apparatus, which is not shown, connected to rod 18 pivotally secured to arcuate pressure shoe 14. The rod 18 may also be actuated to apply the desired pressure to the arcuate pressure shoe 14. It will be appreciated that the cylindrical press roll 12 and the arcuate pressure shoe 14 described above and shown in FIGS. 1 and 2 are conventional in the art.

A first papermaker's wet press fabric 20, a second papermaker's wet press fabric 22, and a fibrous web 24 being processed into a paper sheet are included in FIGS. 1 and 2. The motions of the belt 16, the first papermaker's wet press fabric 20, the second papermaker's wet press fabric 22, and the fibrous web 24 through the press nip 10 are upward in FIG. 1. Lubricating means 26 in FIG. 1 dispenses oil onto the side of belt 16 facing arcuate pressure shoe 14 to facilitate its sliding motion thereagainst.

Figure 3:
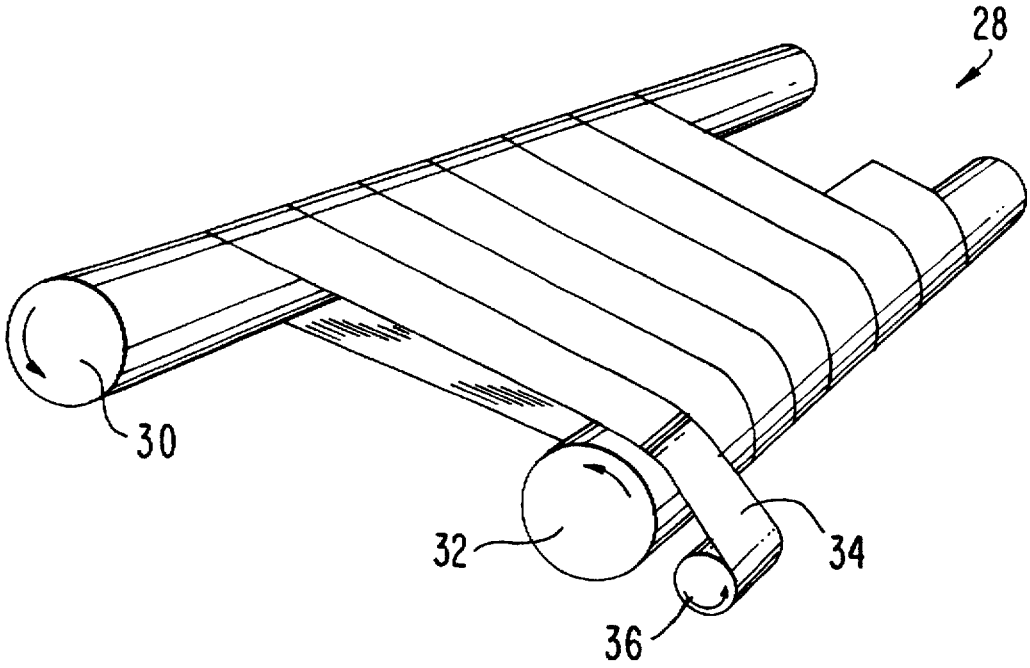
FIG. 3 is a perspective view of an apparatus used for assembling the woven base fabric for the belt of the present invention.

Belt 10 of the present invention includes a base comprising a plurality of non-overlapping turns of a spirally wound prepared structure strip. FIG. 3 is a perspective view of an apparatus used for assembling the base. The apparatus 28 comprises a first roll 30 and a second roll 32, which are parallel to one another and which may be rotated in the directions indicated by the arrows. A prepared structure strip 34 is wound from a stock roll 36 and around first roll 30 and second roll 32 in a spiral. The stock roll 36 must be translated at a suitable rate along second roll 32 as the prepared structure strip 34 is being wound around the rolls 30,32.

Figure 4:
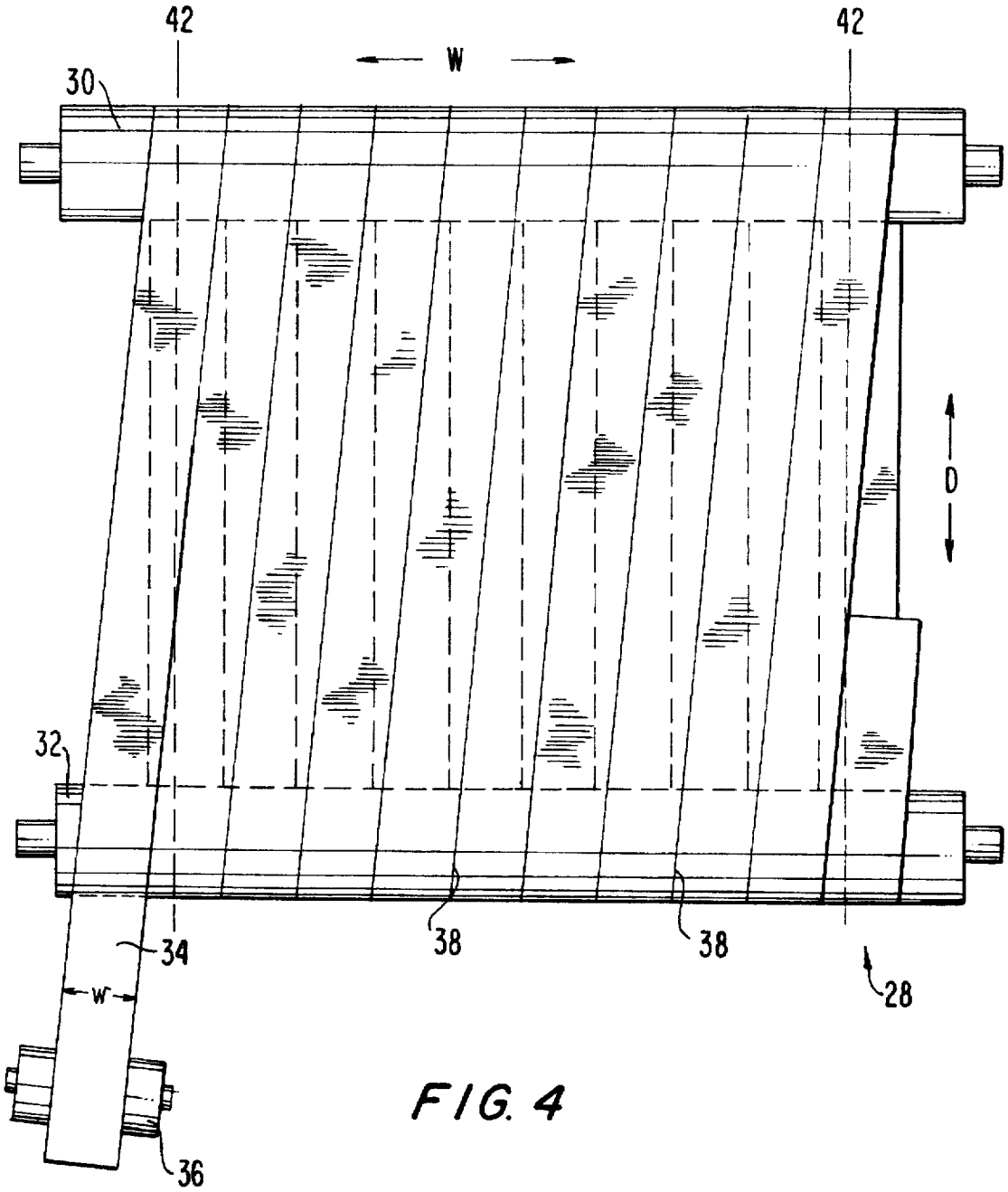
FIG. 4 is a top plan view of the same apparatus.
Figure 5:
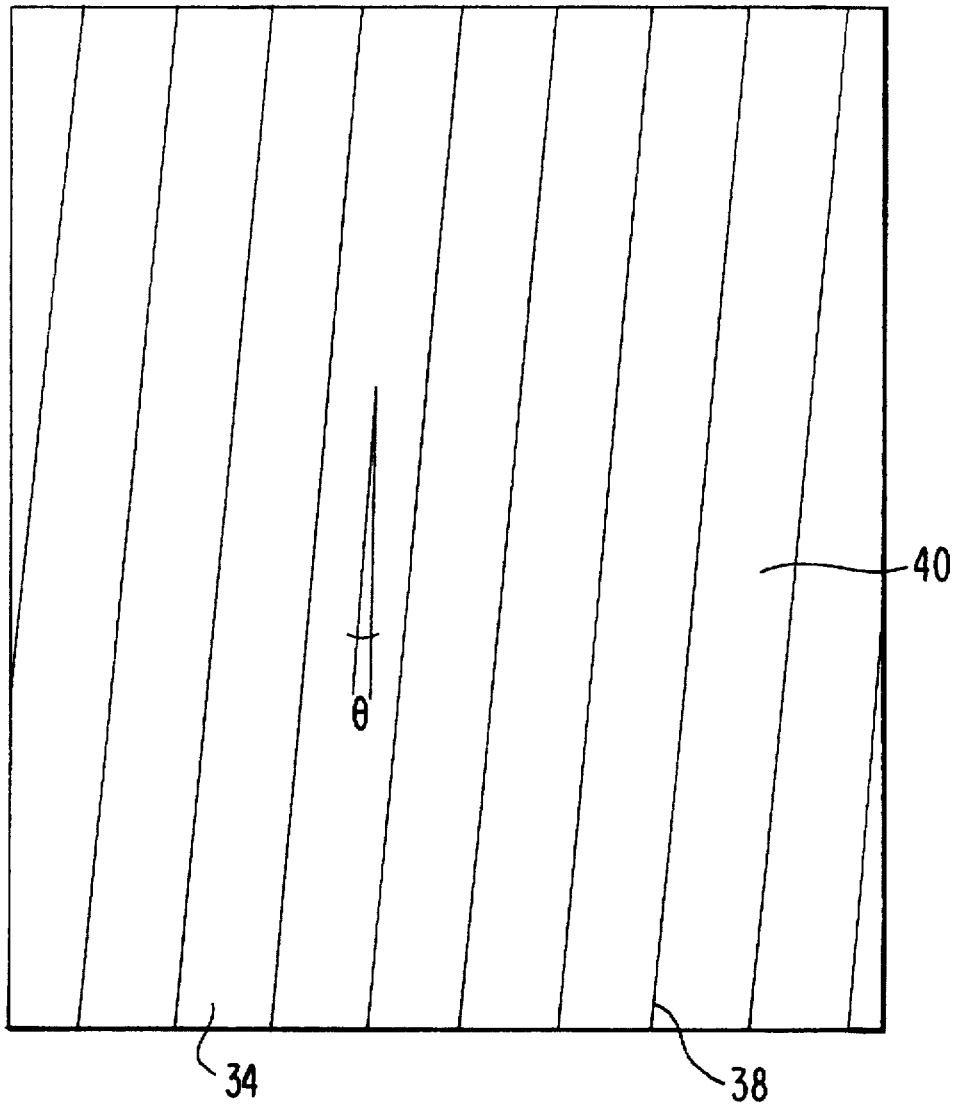
FIG. 5 is a top plan view of the finished woven base fabric.

A top plan view of the apparatus 28 is provided in FIG. 4. The first roll 30 and the second roll 32 are separated by a distance D, which is determined with reference to the total length required for the belt 16 to be manufactured. Prepared structure strip 34, having a width w, is spirally wound onto the first and second rolls 30,32 in a plurality of non-overlapping turns from stock roll 36, which is translated along second roll 32 in the course of the winding. Successive turns of the prepared structure strip 34 are abutted against one another, and are joined to one another by stitching or bonding along spirally continuous seam 38 to produce a base 40 as shown in FIG. 5. When a sufficient number of turns of the prepared structure strip 34 have been made to make a base 40 of desired width W, the spiral winding is concluded. The base 40 so obtained has an inner surface, an outer surface, a longitudinal direction, and a transverse direction. The lateral edges of the base 40 will initially not be parallel to the longitudinal direction thereof, and must be trimmed along lines 42 to provide the base 40 with the desired width W, and with two lateral edges parallel to the longitudinal direction of its endless-loop form.

Prepared structure strip 34 may be a fabric strip woven from yarns of a synthetic polymeric resin, such as polyester or polyamide, in the same manner as other fabrics used in the papermaking industry are woven. After weaving, it may be heat-set in a conventional manner prior to interim storage on stock roll 36. Such a fabric strip may include lengthwise yarns and crosswise yarns, and may be of a single- or multi-layer weave. Because the fabric strip is spirally wound to assemble a woven base fabric, its lengthwise and crosswise yarns do not align with the longitudinal and transverse directions, respectively, of the woven base fabric. Rather, the lengthwise yarns make a slight angle, θ, whose magnitude is a measure of the pitch of the spirally wound fabric strip, with respect to the longitudinal direction of the woven base fabric, as suggested by the top plan view of the base 40 shown in FIG. 5.

Where the prepared structure strip 34 is a woven fabric strip, and, consequently, base 40 is a woven base fabric, the fabric strip is of a weave sufficiently open to permit complete impregnation thereof by the polymeric resin coating material. Complete impregnation eliminates the possibility of undesirable voids forming in the finished belt 16. Voids are particularly undesirable because they may allow the lubricating oil used between the belt 16 and the arcuate pressure shoe 14 to pass through the belt 16 and contaminate the press fabric 20, or press fabrics 20,22, and fibrous web 24 being processed into paper.

Alternatively, prepared structure strip 34 may be a non-woven fabric strip, a perforated synthetic strip, or a polymeric film strip.

Figure 6:
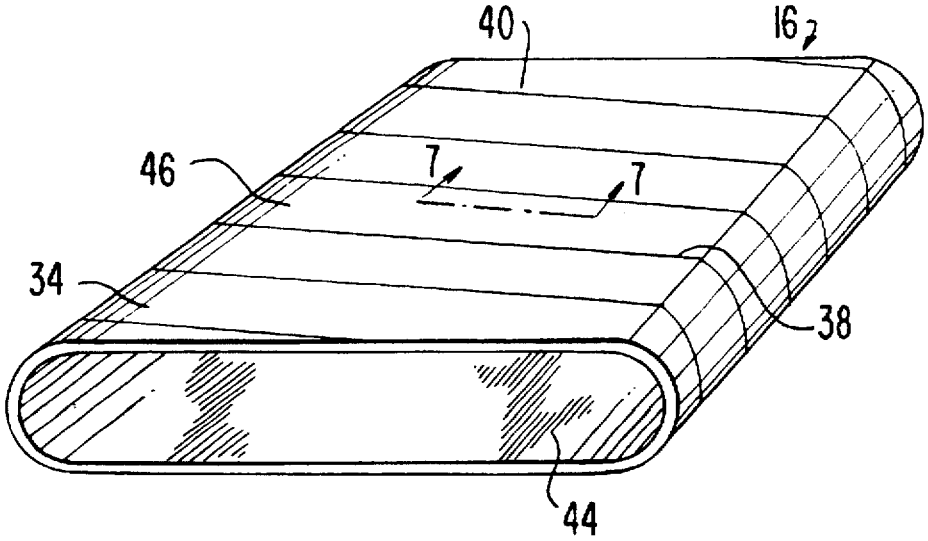
FIG. 6 is a perspective view of the belt of the present invention.

A perspective view of belt 16 is provided in FIG. 6. The belt has an inner surface 44 and an outer surface 46. On the outer surface 46, the base 40 and its spirally continuous seam 38 may be visible.

Figure 7:
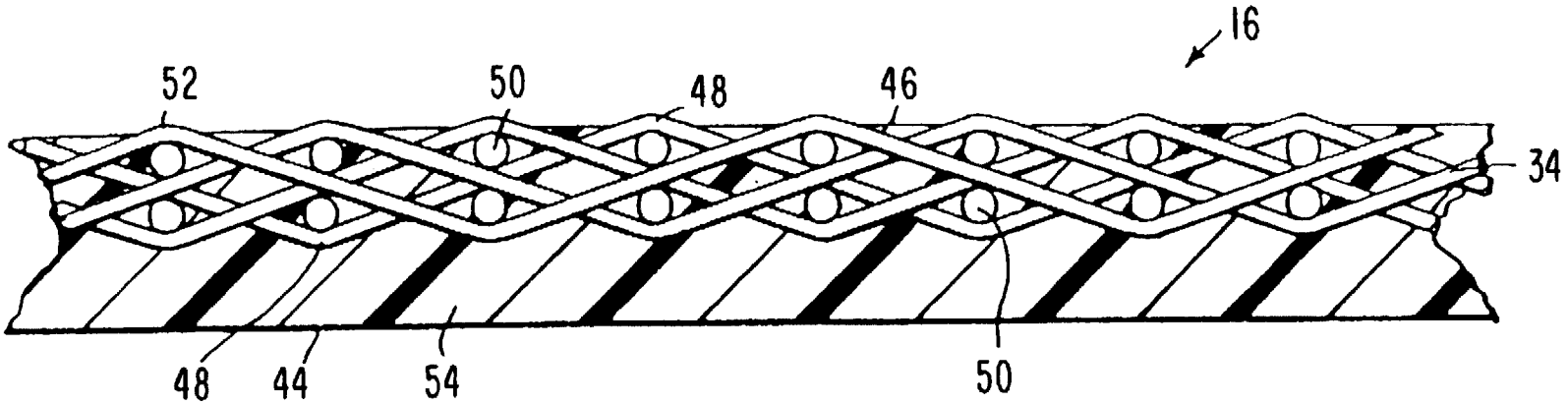
FIG. 7 is a cross-sectional view of the belt taken as indicated by line 7—7 in FIG. 6.

FIG. 7 is a cross-section taken as indicated by line 7—7 in FIG. 6 for the case where prepared structure strip 34 is a fabric strip. The cross-section is taken lengthwise with respect to the fabric strip. Fabric strip 34 is woven from lengthwise yarns 48 and crosswise yarns 50 in a multi-layer weave. Knuckles 52 appearing on the fabric strip 34 where lengthwise yarns 48 weave over crosswise yarns 50 may be visible on the outer surface 46 of the belt 16. The inner surface 44 of the belt 16 is formed by a polymeric resin coating 54.

The polymeric resin coating 54 is applied to at least one surface of the base 40, that surface being the one which will ultimately be the inner surface 44 of the belt 16. As the inner surface 44 slides across the lubricated arcuate pressure shoe 14, the polymeric resin coating 54 protects the base 40 from such sliding contact and the wear by abrasion that would otherwise result. The polymeric resin also impregnates the base 40 and renders the belt 16 impervious to oil and water. The polymeric resin coating 54 may be of polyurethane, and is preferably a 100% solids composition thereof to avoid the formation of bubbles during the curing process through which the polymeric resin proceeds following its application onto the base 40. After curing, the polymeric resin coating 54 is ground and buffed to provide the belt 16 with a smooth surface and a uniform thickness.

Figure 8:
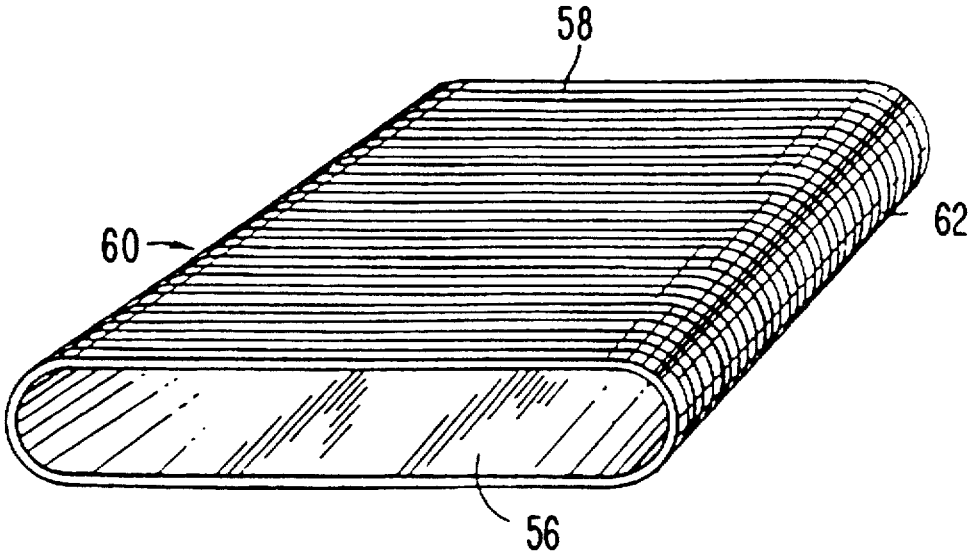
FIG. 8 is a perspective view of an alternate embodiment belt of the present invention.

In an alternate embodiment of the present invention, both surfaces of the woven base fabric 40 may be coated with a polymeric resin. Following the curing of the polymeric resin material, both the inner surface 56 and the outer surface 58 of belt 60, as shown in FIG. 8, may be ground and buffed to provide the belt 60 with smooth surfaces and a uniform thickness. Finally, the outer surface 58 may be provided, by cutting, scoring or graving, with a plurality of grooves 62, for example, in the longitudinal direction around the belt 60, for the temporary storage of water pressed from fibrous web 24 in the press nip 10.

It will be recognized that modifications to the above would be obvious to anyone of ordinary skill in the art without departing from the claims appended hereinbelow.

What is claimed is:

1. A belt on a long nip press for dewatering a fibrous web, said long nip press having a cylindrical press roll and an arcuate pressure shoe which together define a nip therebetween, said belt being passed through said nip in conjunction with at least one press fabric supporting and carrying said fibrous web to be dewatered between said press fabric and said arcuate pressure shoe, said belt comprising:

a base comprising a spirally wound prepared structure strip, said strip having a width smaller than a width of said base, said base being a plurality of non-overlapping turns of said spirally wound prepared structure strip, adjacent non-overlapping turns of said spirally wound prepared structure strip being abutted against and joined directly to one another, said base thereby having the form of an endless loop with an inner surface, an outer surface, a longitudinal direction and a transverse direction; and a coating of a polymeric resin on at least said inner surface of said base, said coating impregnating and rendering said base impervious to liquids and forming a layer on at least said inner surface, said coating being smooth and providing said belt with a uniform thickness.

2. A belt on a long nip press as claimed in claim 1 wherein said polymeric resin is polyurethane.

3. A belt on a long nip press as claimed in claim 1 wherein said prepared structure strip is a woven fabric strip, said strip being woven from lengthwise and crosswise yarns.

4. A belt on a long nip press as claimed in claim 3 wherein said woven fabric strip is impregnated with said coating.

5. A belt on long nip press as claimed in claim 3 wherein said fabric strip is a multi-layer fabric.

6. A belt on a long nip press as claimed in claim 3 wherein said fabric strip is a single-layer fabric.

7. A belt on a long nip press as claimed in claim 3 wherein said lengthwise yarns and said crosswise yarns of said fabric strip are of a synthetic polymeric resin selected from the group consisting of polyester and polyamide resins.

8. A belt on a long nip press as claimed in claim 1 wherein said prepared structure strip is a non-woven fabric strip.

9. A belt on a long nip press as claimed in claim 8 wherein said non-woven fabric strip is impregnated with said coating.

10. A belt on a long nip press as claimed in claim 1 wherein said prepared structure strip is a perforated synthetic strip.

11. A belt on a long nip press as claimed in claim 10 wherein said perforated synthetic strip is perforated with holes selected from the group consisting of round holes, square holes, chevron-shaped holes and diamond-shaped holes.

12. A belt on a long nip press as claimed in claim 1 wherein said prepared structure strip is a polymeric film strip.

13. A belt on a long nip press as claimed in claim 1 wherein said base has two lateral edges, said two lateral edges being parallel to one another, aligned with said longitudinal direction of said base, and defining the width of said base.

14. A belt on a long nip press as claimed in claim 1 wherein said adjacent turns are joined to one another by stitching.

15. A belt on a long nip press as claimed in claim 1 wherein said adjacent turns are joined to one another by fiber entanglement.

16. A belt on a long nip press as claimed in claim 1 wherein said adjacent turns are joined to one another by bonding.

17. A belt on a long nip press as claimed in claim 16 wherein said bonding is effected by ultrasonic welding.

18. A belt on a long nip press as claimed in claim 16 wherein said bonding is effected by heat fusion.

19. A belt on a long nip press as claimed in claim 16 wherein said bonding is effected by chemical bonding.

20. A belt on a long nip press as claimed in claim 1 further comprising a coating of a polymeric resin on said outer surface of said base, said coating being smooth and providing said belt with a uniform thickness.

21. A belt on a long nip press as claimed in claim 20 further comprising a plurality of grooves in said coating on said outer surface of said base.

22. A belt on a long nip press as claimed in claim 20 wherein said coating on said outer surface of said base is ground and buffed to give said belt a uniform thickness.

23. A belt on a long nip press as claimed in claim 1 wherein said coating on said inner surface of said base is ground and buffed to give said belt a uniform thickness.

* * * * *